US011492891B1

(12) United States Patent
Pan et al.

(10) Patent No.: US 11,492,891 B1
(45) Date of Patent: Nov. 8, 2022

(54) METHOD AND APPARATUS OF CONTROLLING DRILLING FOR ROCK BURST PREVENTION IN COAL MINE ROADWAY

(71) Applicants: LIAONING UNIVERSITY, Shenyang (CN); NORTHEASTERN UNIVERSITY, Shenyang (CN)

(72) Inventors: Yishan Pan, Shenyang (CN); Lianpeng Dai, Shenyang (CN)

(73) Assignees: LIAONING UNIVERSITY, Shenyang (CN); NORTHEASTERN UNIVERSITY, Shenyang (CN)

( * ) Notice: Subject to any disclaimer, the term of this patent is extended or adjusted under 35 U.S.C. 154(b) by 0 days.

(21) Appl. No.: 17/673,544

(22) Filed: Feb. 16, 2022

(51) Int. Cl.
*E21B 44/00* (2006.01)
*E21B 49/00* (2006.01)
*E21D 9/00* (2006.01)

(52) U.S. Cl.
CPC ..... *E21B 44/00* (2013.01); *E21B 49/00* (2013.01); *E21D 9/001* (2013.01)

(58) Field of Classification Search
CPC ..... E21B 44/00; E21B 49/00; E21D 9/001
See application file for complete search history.

(56) References Cited

U.S. PATENT DOCUMENTS 10,774,642 B1 * 9/2020 Pan ..... E21D 15/44

FOREIGN PATENT DOCUMENTS

| | | | | |
|---|---|---|---|---|
| CN | 105631102 A | | 6/2016 | |
| CN | 108843329 A | * | 11/2018 | ..... E21D 11/00 |
| CN | 111175121 A | | 5/2020 | |
| CN | 113803067 A | * | 12/2021 | |
| CN | 114320318 A | * | 4/2022 | |

* cited by examiner

*Primary Examiner* — Daniel P Stephenson
(74) *Attorney, Agent, or Firm* — Calfee Halter & Griswold LLP

(57) ABSTRACT

A method for controlling drilling for rock burst prevention drilling in a coal mine roadway is provided. The method comprises: acquiring rock mechanical parameters of coal mass in surrounding rock of a roadway to be subjected to burst-preventing drilling construction, and calculating a surrounding rock critical softening depth, a critical ground stress and a critical mining peak stress for rock burst initiation in the roadway; calculating a critical mining-induced stress index of the roadway to realize quantification of burst risk; then determining critical conditions for drill-hole burst and a quantitative relationship between the critical conditions for drillhole burst and for roadway rock burst initiation; quantitatively determining construction parameters of burst-preventing drillholes according to the surrounding rock critical softening depth, a critical plastic softening zone radius for drillhole burst, and the critical mining-induced stress index; and controlling a drilling machine to operate according to the determined construction parameters.

6 Claims, 6 Drawing Sheets

METHOD AND APPARATUS OF CONTROLLING DRILLING FOR ROCK BURST PREVENTION IN COAL MINE ROADWAY

FIELD OF THE INVENTION

The present invention relates to the technical field of mine safety, and in particular relates to a method and apparatus of controlling drilling for rock burst prevention in coal mine roadway.

BACKGROUND OF THE INVENTION

In recent years, rock burst accidents occur frequently, so that a large number of roadways are destructed, apparatus is damaged and casualties are caused, the economic development is severely restricted, and the life safety of underground workers is threatened. By means of scientific and reasonable pressure relief measures, the burst tendency and risk of coal mass can be reduced by changing the physical and mechanical properties of the coal and rock mass and modifying stress environment, and therefore, the purpose of effectively preventing and controlling rock bursts is achieved.

As the most economical and effective burst-preventing method for preventing rock bursts through effective active pressure relief, burst-preventing drilling is most widely used. The technical essence of burst-preventing drilling is to artificially damage the coal mass and locally reduce the bearing capacity of surrounding rock by constructing drillholes in coal rock, and to regulate and control the size and distribution of mining-induced stress, so as to achieve the purpose of increasing burst initiation thresholds or eliminating the possibility of rock bursts. A quantitative determination method for burst-preventing drilling parameters is the key of whether drilling burst-preventing can achieve the scientific and effective pressure relief effect. If the density of the drillholes is too small, the burst-preventing purpose cannot be achieved; and otherwise, if the density of the constructed drillholes is too large, the roadway surrounding rock may be largely deformed and unstable, and the problems such as increasing the construction cost and reducing the construction efficiency may be caused. Therefore, a reasonable method for determining the burst-preventing drilling parameters is the fundamental prerequisite for the drilled coal mass to achieve burst preventing and maintain roadway stability, and is also an important basis for quantitative evaluation of burst-preventing efficiency.

In the aspect of burst-preventing drilling parameterization design, the Chinese Patent Publication No. CN105631102A discloses a numerical simulation determination method of a deep high-stress roadway drilling pressure relief parameter, wherein a coal rock sample is subjected to a loading and unloading test in a laboratory, an attenuation relationship between a coal rock strength parameter and a damage variable is obtained by fitting and is embedded into an FLAC3D strain softening model, and inversion is carried out on the numerical calculation model parameter of a rock mass; and a drilling pressure relief numerical simulation calculation model is established to determine a reasonable drilling pressure relief construction parameter by simulation. The Chinese Patent Publication No. CN111175121A discloses a roadway surrounding rock drilling pressure relief analog simulation test system and a using method. Through laboratory tests of similar material simulation, the study and analysis of a coal rock stress distribution law under the condition of arrangement of the drillhole pressure relief parameters are performed, a quantitative relationship between the drilling pressure relief parameters and the burst-preventing effect is established, and burst-preventing drilling parametrization design is further optimized.

Existing burst-preventing drilling parameter determination methods belong to qualitative or statistical quantitative determination methods, and one method is to establish a numerical model by using a numerical simulation method, and to statistically and quantitatively determine drilling parameters of on-site construction by regulating pressure relief parameters; and the other is to perform laboratory tests of similar material simulation, and perform optimization design on the burst-preventing drilling parameters via the relationship between the drilling pressure relief parameters and the burst-preventing effect established through tests. However, studies have found that the damage and pressure relief degree of the drilled coal mass is obviously influenced by various parameters such as coal mass burst tendency, coal mass uniaxial compressive strength, coal rock residual strength, drillhole diameter, drillhole spacing, roadway size and the like. A qualitative or statistical quantitative drilling parameter determination method is relatively single in influence factor consideration and relatively large in error.

SUMMARY OF THE INVENTION

Aiming at the defects in the prior art, the present invention provides a method and apparatus for controlling drilling for rock burst prevention in a coal mine roadway. By calculating a surrounding rock critical softening zone depth for rock burst initiation in a roadway to be subjected to burst-preventing drilling construction, critical conditions for drillhole burst occurrence, and roadway burst risk under a current stress, drilling parameters of burst-preventing drilling in the rock burst roadway are quantitatively determined, and thus the construction design of the burst-preventing drilling is more scientific and efficient.

In order to solve the above-mentioned problem, the present invention adopts the following technical solution: a method for controlling drilling for rock burst prevention in a coal mine roadway, comprising the following steps:

S1, acquiring rock mechanical parameters of coal mass in surrounding rock of a roadway to be subjected to burst-preventing drilling construction, the rock mechanical parameters comprising uniaxial compressive strength $\sigma_c$, elastic modulus E, a burst modulus index $K=\lambda_1/E$, residual modulus reduction $\lambda_2$, and a residual strength coefficient $\xi$, wherein $\lambda_1$ is post-peak softening modulus;

S2: calculating a surrounding rock critical softening depth $L_{pcr}$, a critical ground stress $P_{cr}$ and a critical mining peak stress $P_{mcr}$ of a surrounding rock stress concentration zone for rock burst initiation in the roadway to be subjected to burst-preventing drilling construction;

S3: acquiring a mining peak stress $P_m$ of the coal mass in the surrounding rock of the roadway to be subjected to burst-preventing drilling construction, optimizing the critical mining peak stress $P_{mcr}$ of the surrounding rock stress concentration zone for rock burst initiation, and calculating a critical mining-induced stress index $K_{cr}$ of the roadway to be subjected to burst-preventing drilling construction;

$$K_{cr} = \frac{P_m}{P_{mcr}*} \tag{1}$$

wherein $P_{mcr}$* is the optimized critical mining peak stress of the surrounding rock stress concentration zone for rock burst initiation in the roadway to be subjected to burst-preventing drilling construction;

S4: determining critical conditions for drillhole burst occurrence;

calculating a critical fracture zone radius $r_{dcr}$, a critical plastic softening zone radius $r_{pcr}$ and a critical stress $P_{hcr}$ for drillhole burst occurrence, as shown in the following formulas:

$$r_{dcr} = r_0\sqrt{\frac{\alpha}{\beta}} \tag{2}$$

$$r_{pcr} = r_0\sqrt{\frac{\alpha}{\beta}}\sqrt{(1-\xi)\frac{E}{\lambda_1}+1} \tag{3}$$

$$P_{hcr} = \frac{m+1}{2}\sigma_c\left(\frac{p_{dcr}}{\sigma_c}+\frac{1+\lambda_1/E}{m-1}\right)\left((1-\xi)\frac{1}{K}+1\right)^{\frac{m-1}{2}} - \frac{\sigma_c\lambda_1/E}{2}\left((1-\xi)\frac{1}{K}+1\right)^{\frac{m+1}{2}} - \frac{1+\lambda_1/E}{m-1}\sigma_c \tag{4}$$

wherein $$p_{dcr} = \left(\frac{\alpha}{1-q}\right)\left[1-\left(\frac{r_{dcr}}{r_0}\right)^{q-1}\right]+\left(\frac{\beta}{1+q}\right)\left[1-\left(\frac{r_{dcr}}{r_0}\right)^{q+1}\right]$$

is an acting stress of a surrounding rock fracture zone on a plastic softening zone when a drillhole burst occurs;

$$\alpha = \sigma_c\left[\frac{\lambda_2}{E}+\frac{\lambda_2}{\lambda_1}(1-\xi)+\xi\right],\ \beta = \sigma_c\left[\frac{\lambda_2}{E}+\frac{\lambda_2}{\lambda_1}(1-\xi)\right],\ m = \frac{1+\sin\varphi}{1-\sin\varphi},$$

$\varphi$ is an internal friction angle of a coal rock medium in the plastic softening zone of the roadway surrounding rock;

$$q = \frac{1+\sin\phi'}{1-\sin\phi'},$$

$\varphi'$ is an internal friction angle of the coal rock medium in the fracture zone of the roadway surrounding rock; and $r_0$ is a drillhole radius or a drill bit cutting radius;

S5: determining a relationship between the critical conditions for drillhole burst occurrence and critical conditions for roadway rock burst initiation, which meets the following relational expression:

$$P_{mcr}^{*} > P_{cr} > P_{hcr} \tag{5}$$

S6: quantitatively determining a drillhole diameter, a drillhole depth $L_{drill}$ and drillhole spacing $D_{drill}$ of burst-preventing drillholes according to the surrounding rock critical softening depth $L_{pcr}$ for roadway rock burst initiation, the critical plastic softening zone radius $r_{pcr}$ for drillhole burst occurrence and the critical mining-induced stress index $K_{cr}$; and

S7: controlling a drilling machine to operate according to the determined drillhole diameter, drillhole depth $L_{drill}$ and drillhole spacing $D_{drill}$ of the burst-preventing drillholes.

The drillhole diameter is determined according to the arrangement mode of the burst-preventing drillholes in the rock burst roadway and the self-condition of the mine;

The drillhole depth $L_{drill}$ is determined based on the surrounding rock critical softening depth $L_{pcr}$ for roadway rock burst initiation, as shown in the following formula:

$$L_{drill} = \eta_d\eta_L L_{pcr} \tag{6}$$

wherein $\eta_d$ is a correction coefficient for coal seam thickness; when the coal seam thickness is greater than 0 m and less than 4 m, the value range of $\eta_d$ is $0.8 \le \eta_d \le 0.9$; when the coal seam thickness is 4-8 m, the value range of $\eta_d$ is $0.9 \le \eta_d \le 1.0$; when the coal seam thickness is greater than 8 m, the value range of $\eta_d$ is $1.0 \le \eta_d \le 1.2$; $\eta_L$ is a burst-preventing safety coefficient for the drillhole depth; two determination methods are provided for $\eta_L$: one is to determine $\eta_L$ according to the critical mining-induced stress index $K_{cr}$ of burst risk evaluation, namely $\eta_L = 0.85 + 0.5K_{cr}$; and the other method is to determine $\eta_L$ according to a burst risk level obtained by burst risk evaluation based on a comprehensive index method.

The drillhole spacing $D_{drill}$ is determined based on the critical plastic softening zone radius $r_{pcr}$ for drillhole burst occurrence, and is as shown in the following equation:

$$D_{drill} = 2\eta_{pcr} r_{pcr} \tag{7}$$

combining formula (3) with formula (7) to further obtain $$D_{drill} = \eta_{pcr} d\sqrt{\frac{\alpha}{\beta}}\sqrt{(1-\xi)\frac{1}{K}+1} \tag{8}$$

wherein $\eta_{pcr}$ is a burst-preventing safety coefficient for burst-preventing drillhole spacing, d is the diameter of a drill bit in burst-preventing drilling construction, $d = 2r_0$; two determination methods are provided for $\eta_{pcr}$: one is to determine $\eta_{pcr}$ according to a critical stress index method of burst risk evaluation, namely $\eta_{pcr} = 2.325 - 1.75K_{cr}$; and the other method is to determine $\eta_{pcr}$ according to the burst risk level obtained by the burst risk evaluation method based on the comprehensive index method.

In addition, the present application further provides apparatus for controlling drilling for rock burst prevention in a coal mine roadway, the apparatus comprising a memory and a processor that is configured to perform the method for controlling drilling for rock burst prevention in a coal mine roadway.

The beneficial effects produced by adopting the above-mentioned technical solution are as follows: the method and apparatus for controlling drilling for rock burst prevention in a coal mine roadway provided by the present invention put forward a quantitative design criterion for the burst-preventing drilling parameters directly related to coal rock mechanical parameters, drillhole size parameters, roadway structure parameters and the current stress, and the burst-preventing drilling parameters under the guidance of a burst-preventing theory are determined. By calculating the critical conditions for rock burst initiation in the roadway to be subjected to burst-preventing drilling construction and the critical conditions for drillhole burst occurrence, a theoretical method for quantitatively determining the drilling parameters of burst-preventing drilling in the rock burst roadway and a calculation formula of the theoretical method are proposed, and thus the construction design of the burst-preventing drilling is more scientific and efficient.

In addition, according to the determined burst-preventing drilling parameters, in the rock burst roadway in a deep coal mine, a mine drilling machine is utilized to construct drillholes in coal seams to regulate and control the risk of the coal seam rock bursts, thereby realizing effective prevention and control of rock burst disasters, preventing the loss of underground apparatus and property caused by the rock bursts, and eliminating the threat to lives of workers caused by the rock bursts.

In the figures: 1, mining-induced stress concentration zone; 2, disturbance stress wave; and 3, drillhole.

DETAILED DESCRIPTION OF THE EMBODIMENTS

The specific implementation of the present invention will be further described in detail below in combination with the accompanying drawings and embodiments. The embodiments below are adopted to illustrate the present invention, but not to limit the scope of the present invention.

This embodiment takes the main 5# coal seam of a mine in Hebei as an example, and by the adoption of a method for controlling drilling for rock burst prevention in a coal mine roadway provided by the invention, drilling parameters of burst-preventing drillholes in a rock burst roadway of the coal seam can be determined, and a drilling machine is controlled to operate according to the drilling parameters.

Figure 1:
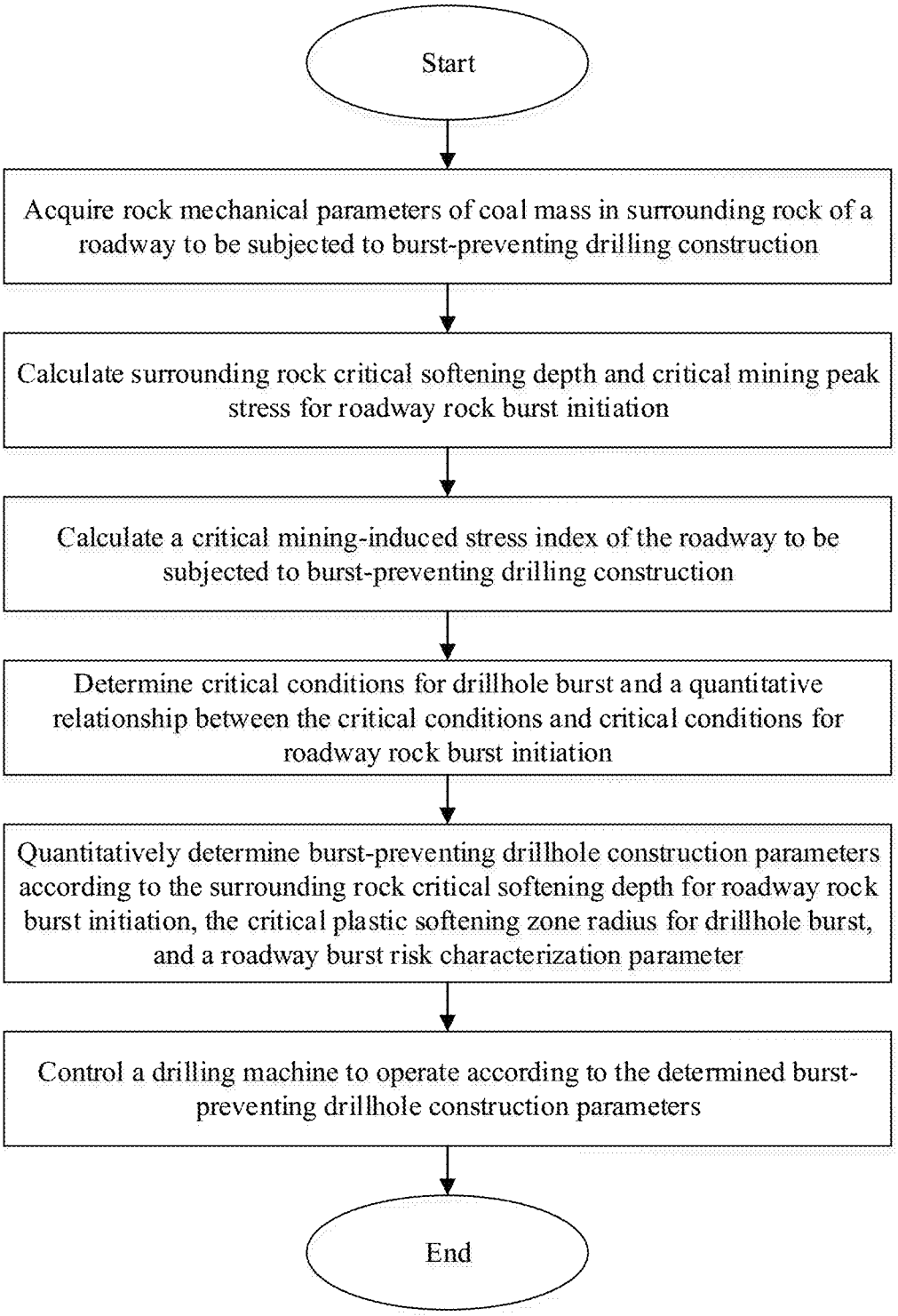
FIG. 1 is a flowchart of a method for controlling drilling for rock burst prevention in a coal mine roadway provided by an embodiment of the present invention.

A burst-preventing drilling parameter determination method for a rock burst roadway in a coal mine, as shown in FIG. 1, comprises the following steps:

S1, acquiring rock mechanical parameters of coal mass in surrounding rock of the roadway to be subjected to burst-preventing drilling construction, the rock mechanical parameters comprising uniaxial compressive strength $\sigma_c$, elastic modulus E, a burst modulus index $K=\lambda_1/E$, residual modulus reduction $\lambda_2$, and a residual strength coefficient $\xi$, wherein $\lambda_1$ is post-peak softening modulus;

in this embodiment, the coal seam has an average thickness of 7.03 m, an inclination angle of 13 degrees, and an average buried depth of 984 m. The average uniaxial compressive strength of the coal mass is 10 MPa. The coal seam has a weak burst tendency, a roof has a weak burst tendency, and a floor has no burst tendency. The physical parameters of coal rock, support strength and geometric characteristic parameters of the roadway are shown in Table 1 for details;

S2: calculating a surrounding rock critical softening depth $L_{pcr}$, a critical ground stress $P_{cr}$ and a critical mining peak stress $P_{mcr}$ of a surrounding rock stress concentration zone for rock burst initiation in the roadway to be subjected to burst-preventing drilling construction;

S2.1: acquiring a support stress $p_s$ of the roadway to be subjected to burst-preventing drilling construction;

S2.2: calculating a critical fracture zone radius $\rho_{fcr}$ and a critical softening zone radius $\rho_{cr}$ for rock burst initiation in the roadway to be subjected to burst-preventing drilling construction, as shown in the following formulas:

$$\rho_{fcr} = \rho_0\sqrt{\frac{p_s(q-1)+\alpha}{\beta}} \tag{1}$$

$$\rho_{cr} = \rho_0\sqrt{\frac{p_s(q-1)+\alpha}{\beta}}\sqrt{(1-\xi)\frac{E}{\lambda_1}+1} \tag{2}$$

wherein $\rho_0$ is a roadway radius after the roadway to be subjected to burst-preventing drilling construction is equivalent to a homogeneous, continuous and isotropic circular roadway;

$$q = \frac{1+\sin\phi'}{1-\sin\phi'},$$

$\varphi'$ is an internal friction angle of a coal rock medium in a fracture zone of the roadway surrounding rock, $$\alpha = \sigma_c\left[\frac{\lambda_2}{E}+\frac{\lambda_2}{\lambda_1}(1-\xi)+\xi\right],\ \beta = \sigma_c\left[\frac{\lambda_2}{E}+\frac{\lambda_2}{\lambda_1}(1-\xi)\right];$$

S2.3: calculating the surrounding rock critical softening depth $L_{pcr}$ and the critical ground stress $P_{cr}$ for rock burst initiation in the roadway to be subjected to burst-preventing drilling construction, as shown in the following formulas:

$$L_{pcr} = \rho_0\sqrt{\frac{p_s(q-1)+\alpha}{\beta}}\sqrt{(1-\xi)\frac{1}{K}+1} - \frac{B}{2} \tag{3}$$

$$P_{cr} = \sigma_c\left\{\frac{m+1}{2}\left(\frac{p_{fcr}}{\sigma_c}+\frac{1+\lambda_1/E}{m-1}\right)\left[1+(1-\xi)\frac{E}{\lambda_1}\right]^{\frac{m-1}{2}} - \frac{\lambda_1/E}{2}\left[1+(1-\xi)\frac{E}{\lambda_1}\right]^{\frac{m+1}{2}} - \frac{1+\lambda_1/E}{m-1}\right\} \tag{4}$$

wherein B is the width of the roadway to be subjected to burst-preventing drilling construction, $$m = \frac{1+\sin\varphi}{1-\sin\varphi},$$

$\varphi$ is an internal friction angle of the coal rock medium in a plastic softening zone of the roadway surrounding rock, and $p_{fcr}$ is an acting stress of the surrounding rock fracture zone on the plastic softening zone when a rock burst is initiated in the roadway to be subjected to burst-preventing drilling construction, as shown in the following formula:

$$p_{fcr} = p_s\left(\frac{\rho_{fcr}}{\rho_0}\right)^{q-1} + \left(\frac{\alpha}{1-q}\right)\left[1-\left(\frac{\rho_{fcr}}{\rho_0}\right)^{q-1}\right] + \left(\frac{\beta}{1+q}\right)\left[1-\left(\frac{\rho_{fcr}}{\rho_0}\right)^{q+1}\right] \quad (5)$$

S2.4: calculating the critical mining peak stress $P_{mcr}$ of the surrounding rock stress concentration zone for rock burst initiation in the roadway to be subjected to burst-preventing drilling construction, as shown in the following formula:

$$P_{mcr} = 2P_{cr} - \frac{2P_{cr} - \sigma_c}{m+1} \quad (6)$$

S3: acquiring a mining peak stress $P_m$ of the coal mass in the surrounding rock of the roadway to be subjected to burst-preventing drilling construction, optimizing the critical mining peak stress $P_{mcr}$ of the surrounding rock stress concentration zone for roadway rock burst initiation, and calculating a critical mining-induced stress index $K_{cr}$ of the roadway to be subjected to burst-preventing drilling construction, and thus achieving the quantification of burst risk, wherein the critical mining-induced stress index $K_{cr}$ quantitatively represents the possibility degree of rock burst occurrence in the roadway to be subjected to burst-preventing drilling construction;

firstly, acquiring the mining peak stress $P_m$ of the coal mass in the surrounding rock of the roadway to be subjected to burst-preventing drilling construction, and optimizing the critical mining peak stress of the surrounding rock stress concentration zone for rock burst initiation in the roadway to be subjected to burst-preventing drilling construction according to the section shape of the roadway to be subjected to burst-preventing drilling construction to be $P_{mcr}^*=n_1\times P_{mcr}$, wherein $n_1$ is a correction coefficient for the section of the roadway to be subjected to burst-preventing drilling construction; when the section of the roadway to be subjected to burst-preventing drilling construction is rectangular, trapezoidal, straight wall arched or circular in shape, $n_1$ is 0.89, 0.92, 0.95 and 0.98, respectively;

then calculating the critical mining-induced stress index $K_{cr}$ of burst risk in the roadway to be subjected to burst-preventing drilling construction, as shown in the following formula:

$$K_{cr} = \frac{P_m}{P_{mcr}^*} \quad (7)$$

Figure 2:
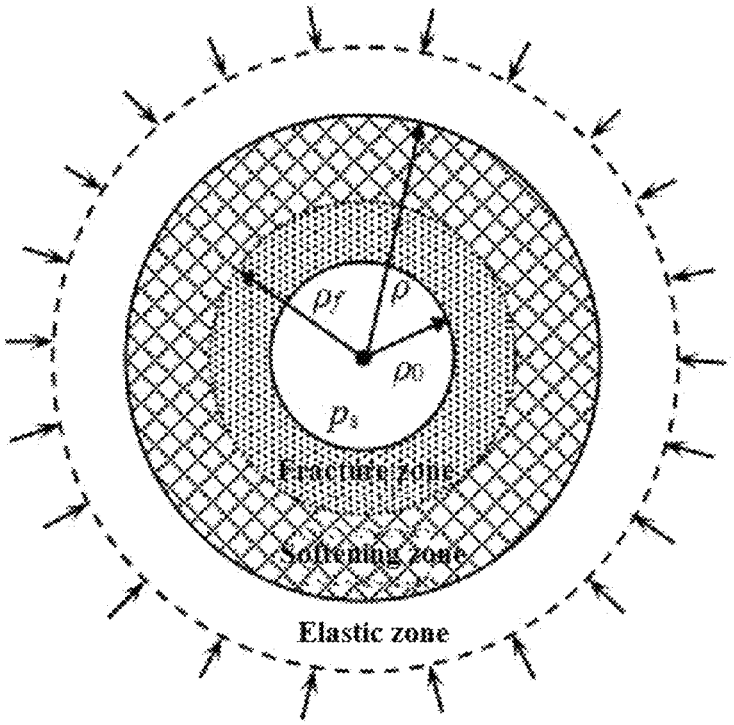
FIG. 2 is a schematic diagram of a mechanical model of roadway rock burst initiation provided by an embodiment of the present invention.
Figure 3:
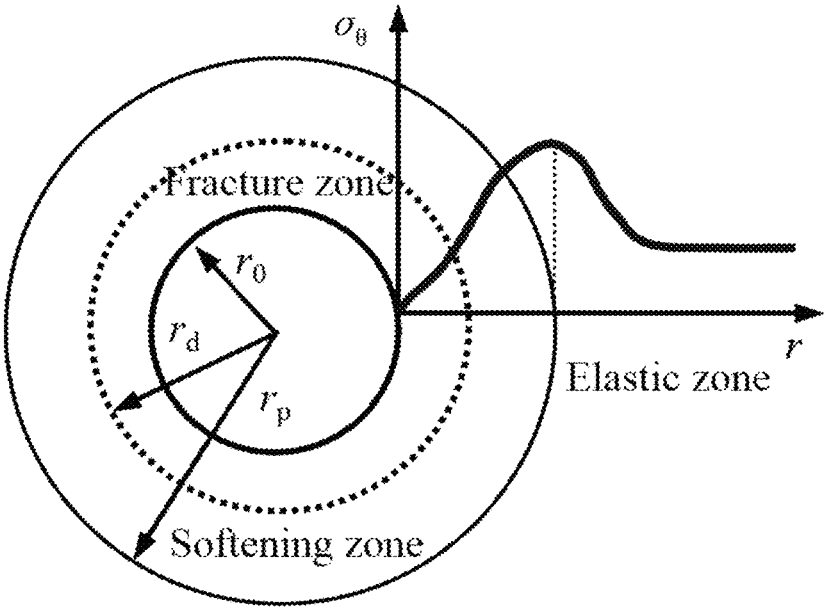
FIG. 3 is a schematic diagram of a mechanical model of drillhole burst occurrence provided by an embodiment of the present invention.

S4: determining critical conditions for drillhole burst occurrence;

S4.1: obtaining a drilled surrounding rock system equation from radial stress continuing conditions of each subzone of the drilled surrounding rock by combining the Mohr-Coulomb yield criterion and boundary conditions $\sigma_r(r_0)=0$ of a radial stress of the surrounding rock at the drillhole wall according to a coal rock equilibrium differential equation, a geometric equation, a constitutive equation and a coal rock damage evolution equation under uniaxial compression from comparison between a mechanical model of the roadway rock bursts shown in FIG. 2 and a mechanical model of drillhole burst occurrence shown in FIG. 3;

the coal rock equilibrium differential equation:

$$\frac{d\sigma_r}{dr} - \frac{\sigma_\theta - \sigma_r}{r} = 0 \quad (8)$$

the geometric equation:

$$\left.\begin{aligned} \varepsilon_r &= \frac{du}{dr} \\ \varepsilon_\theta &= \frac{u}{r} \end{aligned}\right\} \quad (9)$$

wherein r is the radius of the drilled surrounding rock, and while taking different values, r represents different positions of the drilled surrounding rock; $\varepsilon_r$ is radial strain of an elastic zone of the drilled surrounding rock, $\varepsilon_\theta$ is circumferential strain of the elastic zone of the drilled surrounding rock, and u is radial displacement of the drilled) surrounding rock; $\sigma_r(r_0)$ is the radial stress of the surrounding rock at the drillhole wall, $r_\theta$ is a drillhole radius or a drill bit cutting radius, and $\sigma_\theta$ ` $\sigma_r$ are a tangential stress of the elastic zone of the drilled surrounding rock and the radial stress of the surrounding rock respectively;

the constitutive equation:

the constitutive relation in the elastic zone of the drilled surrounding rock meeting:

$$a. \quad \left.\begin{aligned} \sigma_r &= \overline{E}(\varepsilon_r + \overline{v}\varepsilon_\theta) \\ \sigma_\theta &= \overline{E}(\varepsilon_\theta + \overline{v}\varepsilon_r) \end{aligned}\right\} \quad (10)$$

wherein $$\overline{E} = \frac{E(1-v)}{(1+v)(1-2v)}, \ \overline{v} = \frac{v}{(1-v)},$$

v is a Poisson's ratio;

(2) the constitutive relation in the plastic softening zone of the drilled surrounding rock meeting:

$$\frac{\sigma_\theta}{1-D} = m\frac{\sigma_r}{1-D} + \sigma_c \quad (11)$$

Figure 4:
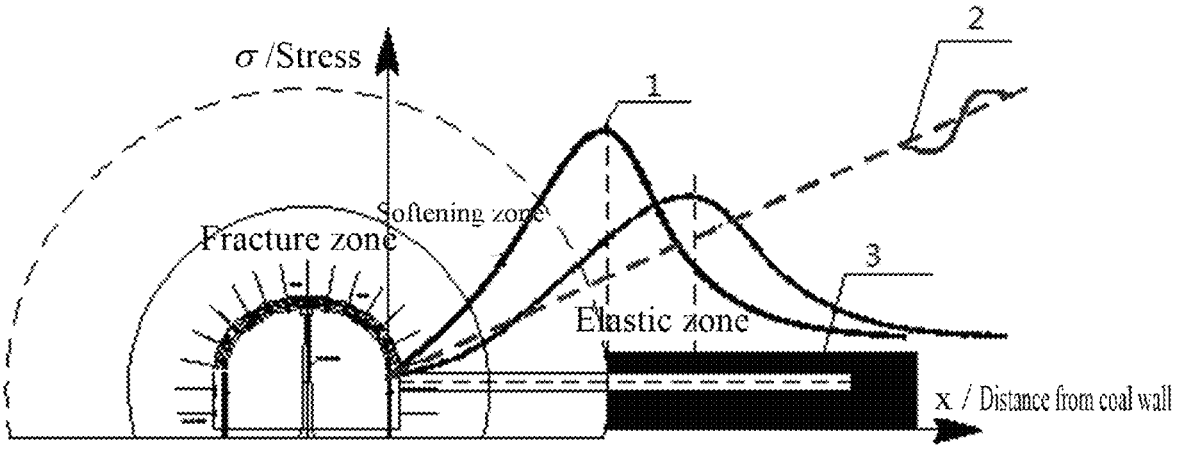
FIG. 4 is a schematic diagram of the relationship between drillhole burst occurrence and roadway rock burst initiation provided by an embodiment of the present invention.

(3) the constitutive relation in the fracture zone of the drilled surrounding rock meeting:

$$\frac{\sigma_\theta}{1-D} = q\frac{\sigma_r}{1-D} + \sigma_c \quad (12)$$

the coal rock damage evolution equation:

$$\left.\begin{aligned} D &= 1 - \left(1 - \frac{r_d^2}{r^2}\right)\gamma - \frac{\xi r_d^2}{r^2} && (r < r_d) \\ D &= \frac{\lambda_1}{E}\left(\frac{r_p^2}{r^2} - 1\right) && (r_d < r < r_p) \\ D &= 0 && (r > r_p) \end{aligned}\right\} \quad (13)$$

wherein D is a damage variable of the coal rock medium in the drilled surrounding rock, $\gamma=\lambda_2/E+(1-\xi)\lambda_2/\lambda_1+\xi$, $r_d$ is the radius of the fracture zone of the drilled surrounding rock, and $r_p$ is the radius of the plastic softening zone of the drilled surrounding rock;

obtaining the drilled surrounding rock system equation from the radial stress continuing conditions of each sub-zone of the drilled surrounding rock by combining the Mohr-Coulomb yield criterion and boundary conditions $\sigma_r(r_0)=0$ of the radial stress of the surrounding rock at the drillhole wall, as shown in the following formula:

$$P_h = \frac{m+1}{2}\sigma_c\left(\frac{p_d}{\sigma_c} + \frac{1+\lambda_1/E}{m-1}\right)\left((1-\xi)\frac{1}{K}+1\right)^{\frac{m-1}{2}} - \frac{\sigma_c\lambda_1/E}{2}\left((1-\xi)\frac{1}{K}+1\right)^{\frac{m+1}{2}} - \frac{1+\lambda_1/E}{m-1}\sigma_c \tag{14}$$

wherein, $P_h$ is an stress of the drilled surrounding rock, namely a roadway mining-induced stress, and $$p_d = \left(\frac{\alpha}{1-q}\right)\left[1-\left(\frac{r_d}{r_0}\right)^{q-1}\right] + \left(\frac{\beta}{1+q}\right)\left[1-\left(\frac{r_d}{r_0}\right)^{q+1}\right]$$

is the acting stress of the drilled surrounding rock fracture zone on the plastic softening zone;

S4.2: obtaining the critical fracture zone radius $r_{dcr}$, the critical plastic softening zone radius $r_{pcr}$ and the critical stress $P_{hcr}$ for drillhole burst occurrence according to a disturbance response instability criterion $$\frac{dr}{dP_h} = \infty$$

for burst initiation, as shown in the following formulas:

$$r_{dcr} = r_0\sqrt{\frac{\alpha}{\beta}} \tag{16}$$

$$r_{pcr} = r_0\sqrt{\frac{\alpha}{\beta}}\sqrt{(1-\xi)\frac{E}{\lambda_1}+1} \tag{17}$$

$$P_{hcr} = \frac{m+1}{2}\sigma_c\left(\frac{p_{dcr}}{\sigma_c} + \frac{1+\lambda_1/E}{m-1}\right)\left((1-\xi)\frac{1}{K}+1\right)^{\frac{m-1}{2}} - \frac{\sigma_c\lambda_1/E}{2}\left((1-\xi)\frac{1}{K}+1\right)^{\frac{m+1}{2}} - \frac{1+\lambda_1/E}{m-1}\sigma_c \tag{18}$$

wherein $$p_{dcr} = \left(\frac{\alpha}{1-q}\right)\left[1-\left(\frac{r_{dcr}}{r_0}\right)^{q-1}\right] + \left(\frac{\beta}{1+q}\right)\left[1-\left(\frac{r_{dcr}}{r_0}\right)^{q+1}\right]$$

is the acting stress of the surrounding rock fracture zone on the plastic softening zone when the drillhole burst occurs;

S5: determining a relationship between the critical conditions for drillhole burst occurrence and critical conditions for roadway rock burst initiation;

drillhole burst occurrence and roadway rock burst initiation have the same occurrence mechanism, that is, under the high stress condition, coal rock in a softening zone and coal rock in an elastic zone of the roadway or drilled surrounding rock form an unstable balance system, the boundary of the surrounding rock plastic zone generates great nonlinear expansion under external disturbance, and a series of macroscopic responses are triggered. However, for surrounding rock burst-preventing drillholes of a specific roadway, the axial direction of the roadway is perpendicular to the axial direction of the drillhole, as shown in FIG. 4. From the analysis of FIG. 4, it can be seen that the reason for roadway rock burst initiation is that the mining-induced stress of the roadway reaches the critical mining peak stress $P_{mcr}^*$ for roadway rock burst initiation, and the reason for drillhole burst occurrence is that the mining-induced stress of the roadway reaches the critical stress $P_{hcr}$ for drillhole burst occurrence. Therefore, the relationship between drillhole burst occurrence and roadway rock burst initiation is specifically embodied in the following aspects: 1) both drillhole burst occurrence and roadway rock burst initiation have the same disturbance response instability mechanism, that is, the drillhole can be regarded as a circular roadway without support stress; 2) for the specific roadway and the surrounding rock drillholes thereof, the surrounding rock has the same physical and mechanical parameters; 3) in a spatial position, the axis of the roadway is perpendicular to the axes of the drillholes; and 4) driving stress sources for drillhole burst occurrence and roadway rock burst initiation are the same, that is, both stresses are roadway mining concentrated stresses.

In conclusion, according to the critical stress $P_{hcr}$ for drillhole burst occurrence and the optimized critical mining peak stress $P_{mcr}^*$ for roadway rock burst initiation, the relationship between the critical conditions for drillhole burst and the critical conditions for roadway rock burst initiation is determined to meet the following relational expression:

$$P^*_{mcr} > P_{cr} > P_{hcr} \tag{19}$$

From the relationship between the critical conditions for the drillhole burst and the critical conditions for roadway rock burst initiation shown in equation (19), it can be seen that under the driving of the certain mining-induced stress, the critical stress for drillhole burst occurrence are less than the critical stress for roadway rock burst initiation, that is, drillhole burst occurrence is easier than roadway rock burst initiation, which reveals the phenomenon that due to drilling, the drillhole burst occurs but the roadway burst is not initiated in engineering. Therefore, once the critical conditions for drillhole burst occurrence are destroyed, the critical conditions for roadway rock burst initiation can be destroyed, and thus the rock burst is prevented and controlled. Therefore, a quantitative theoretical basis is provided for determining drilling construction parameters for the purpose of preventing and controlling roadway rock burst initiation.

S6: quantitatively determining construction parameters of burst-preventing drillholes according to the surrounding rock critical softening depth $L_{pcr}$ for roadway rock burst initiation, the critical plastic softening zone radius $r_{pcr}$ for drillhole burst occurrence, and a roadway burst risk characterization parameter, namely, the critical mining-induced stress index $K_{cr}$.

S7: controlling a drilling machine to operate according to the determined drillhole diameter, drillhole depth $L_{drill}$ and drillhole spacing $D_{drill}$ of the burst-preventing drillholes.

In the method provided by the present invention, the construction design principle of burst-preventing drilling is as follows:

(1) the critical plastic softening zone radius $r_{pcr}$ for drillhole burst occurrence, a surrounding rock critical softening depth $L_{pcr}$ for roadway rock burst initiation and the critical mining-induced stress index $K_{cr}$ of roadway burst risk are taken as data bases for quantitatively determining the burst-preventing drillhole construction parameters;

(2) the relationship between the critical conditions for drillhole burst occurrence and the critical conditions for roadway rock burst initiation is taken as a theoretical basis for quantitatively determining the burst-preventing drillhole construction parameters;

(3) in the aspect of drillhole depth, the surrounding rock critical softening depth $L_{pcr}$ for roadway rock burst initiation is taken as a calculation basis for determining the drillhole depth; and it is guaranteed that the drilling depth reaches and goes beyond a mining-induced stress concentration zone when the roadway rock burst is initiated, and the key is to calculate the surrounding rock critical softening depth $L_{pcr}$ for roadway rock burst initiation;

(4) in the aspect of drillhole spacing, the critical plastic softening zone radius $r_{pcr}$ for drillhole burst occurrence is taken as the calculation basis for determining the drillhole spacing; and it is guaranteed that the drillhole spacing is enough to destroy the critical plastic softening radius conditions for drillhole burst, and the key is to calculate the critical plastic softening zone radius $r_{pcr}$ for the drillhole burst;

(5) based on the actual situation of the mine, an inner space for deformation and instability in the drillhole can be formed in the coal mass through the determined drillhole diameter, a deformation absorption space is continuously provided for deformation of the surrounding rock under load, and the burst-preventing effect is strengthened;

(6) the arrangement mode of the burst-preventing drillholes is determined according to the coal seam thickness and the Poisson's effect.

Figure 5:
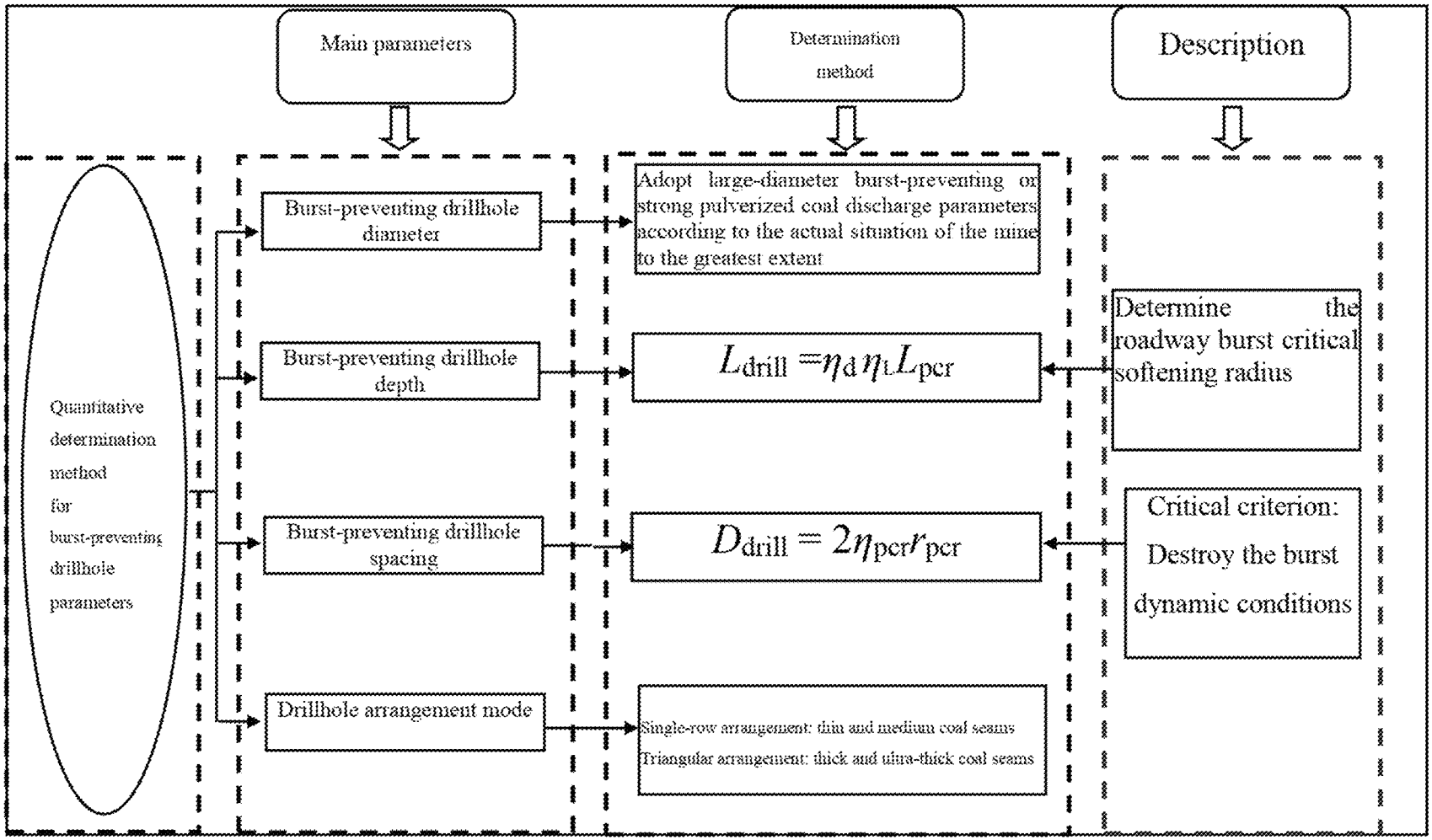
FIG. 5 is a flowchart of design of drilling burst-preventing key parameters provided by an embodiment of the present invention.

Based on the above-mentioned burst-preventing design principle, as shown in FIG. 5, a specific method for quantitatively determining the drillhole diameter, drillhole depth $L_{drill}$ and drillhole spacing $D_{drill}$ of burst-preventing drillholes provided by the present invention is as follows:

I, determining the drillhole diameter according to the arrangement mode of the burst-preventing drillholes in the rock burst roadway and the self-conditions of a mine.

Figure 6:
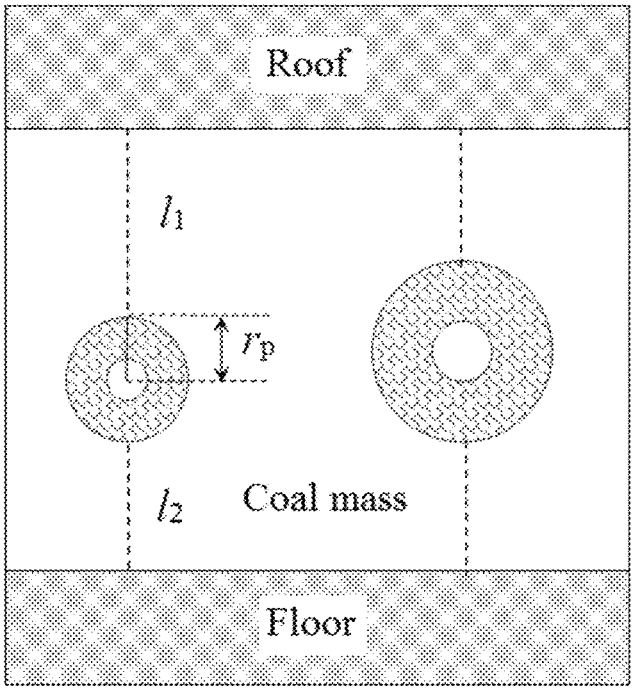
FIG. 6 is a schematic diagram of the influence of a drillhole diameter on the pressure relief effect in the thickness direction of coal mass provided by an embodiment of the present invention.

While the construction depth and spacing of the burst-preventing drillholes are quantitatively determined, in the thickness direction of the coal seam, considering that the burst-preventing drillholes in the rock burst roadway are generally arranged in a row or triangle shapes, the mine should adopt large-diameter drillholes for burst preventing of coal mass to the greatest extent on the basis of self-conditions. The influence of the drillhole diameter on the burst-preventing effect in the thickness direction of the coal mass is shown in FIG. 6. In the figure, $l_1$ and $l_2$ are the vertical distances from the burst-preventing boundary of the drillhole to the roof and the floor respectively. When the coal seam is thick and the burst-preventing effect in the thickness direction of the coal seam is limited, the triangular arrangement mode should be considered.

Theoretical calculation shows that as the diameter of the drillhole is increased, the damage range of the drilled surrounding rock is increased, and the critical softening zone radius for drillhole burst occurrence is increased. At present, the maximum drilling diameter of a mining roadway drilling machine is about 0.4 m, and the common diameter is 0.05 m to 0.2 m. Therefore, increasing the drillhole diameter is conducive to increasing the single-hole burst-preventing effect, correspondingly increasing the drillhole spacing and improving the efficiency of drillhole construction. The drillhole diameter mainly depends on the power of the mine drilling machine. The influence factor is single and easy to determine. Therefore, the determination of the drillhole diameter is the premise for further determining the drillhole spacing parameter.

Figure 7:
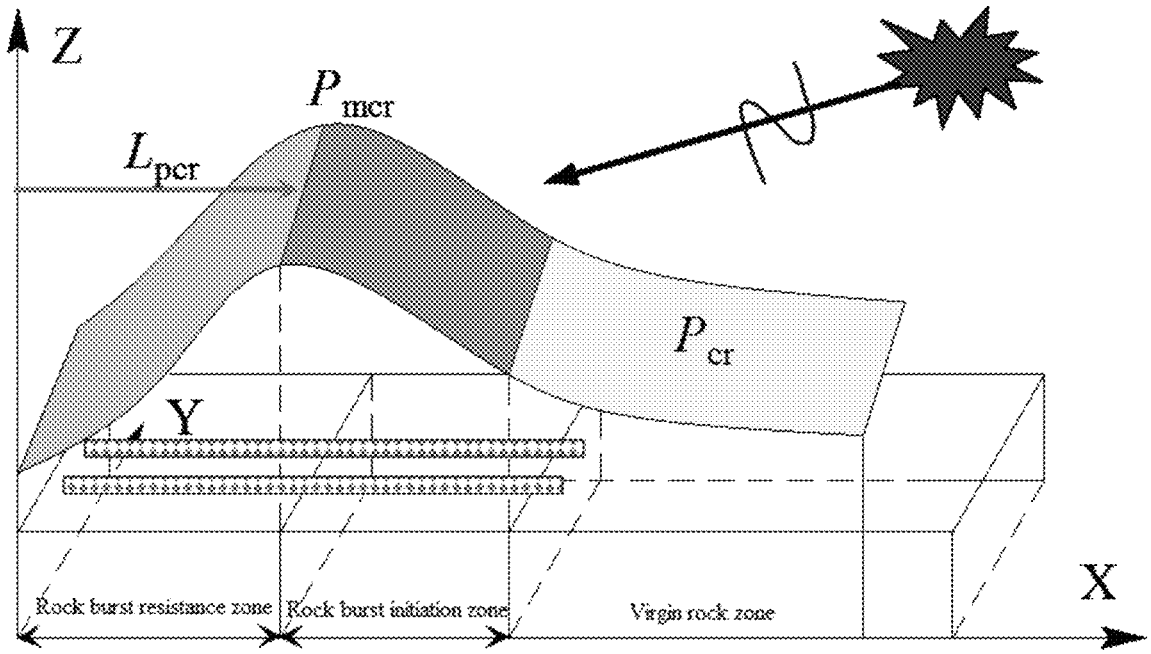
FIG. 7 is a schematic diagram of a drilling depth of drillholes for preventing and controlling rock burst initiation in a roadway provided by an embodiment of the present invention.

II, using the mining-induced stress concentration zone on the roadway side as a limit equilibrium zone of the roadway surrounding rock, and also as a roadway rock burst initiation zone. This zone is a driving stress source for drillhole burst occurrence and roadway rock burst initiation. The acting main object of the drilling burst-preventing is this roadway rock burst initiation zone, as shown in FIG. 7. Therefore, the depth $L_{drill}$ of burst-preventing drillholes should not only penetrate through the mining-induced stress concentration zone of the current roadway, but also penetrate through the surrounding rock critical softening depth $L_{pcr}$ for rock burst initiation.

$$L_{drill}=\eta_d\eta_L L_{pcr} \tag{6}$$

wherein $\eta_d$ is a correction coefficient for coal seam thickness; when the coal seam thickness is greater than 0 m and less than 4 m, the value range of $\eta_d$ is $0.8\leq\eta_d\leq0.9$; when the coal seam thickness is 4-8 m, the value range of $\eta_d$ is $0.9<\eta_d\leq1.0$; when the coal seam thickness is greater than 8 m, the value range of $\eta_d$ is $1.0<\eta_d\leq1.2$; the specific value of $\eta_d$ in each value range is determined according to the actual construction working condition; is a burst-preventing safety coefficient for the drillhole depth, and the value of the safety coefficient is associated with the burst risk of the zone to be subjected to drilling construction, so that the determination of the drillhole depth is related to the stress of the roadway. Two determination methods are provided for $\eta_L$: one is to determine $\eta_L$ according to the critical mining-induced stress index of burst risk evaluation, namely $\eta_L=0.85+0.5K_{cr}$, and this method has the advantages that burst risk characterization adopts a continuously quantified numerical value interval; and the other method is to determine $\eta_L$ according to a burst risk level obtained by burst risk evaluation based on a comprehensive index method commonly used at present, generally, $\eta_L$ is 1.3 in a strong burst risk zone, $\eta_L$ is 1.2 in a moderate burst risk zone, and is 1.1 in a weak burst risk zone.

III, determining the drillhole spacing $D_{drill}$ based on the critical plastic softening zone radius $r_{pcr}$ for drillhole burst occurrence, as shown in the following equation:

$$D_{drill}=2\eta_{pcr}r_{pcr} \tag{21}$$

combining formula (21) with formula (17) to further obtain $$D_{drill}=\eta_{pcr}d\sqrt{\frac{\alpha}{\beta}}\sqrt{(1-\xi)\frac{1}{K}+1} \tag{22}$$

wherein $\eta_{pcr}$ is the burst-preventing safety coefficient for the burst-preventing drillhole spacing, and d is a drill bit diameter in burst-preventing drilling construction, $d=2r_0$.

The value of the burst-preventing safety coefficient $\eta_{pcr}$ for the burst-preventing drillhole spacing is associated with the burst risk of the zone to be subjected to burst-preventing drilling construction, so that the determination of the drillhole spacing is related to a current environmental load. Two determination methods are provided for $\eta_{pcr}$: one is to determine $\eta_L$ according to the critical stress index method of burst risk evaluation, namely $\eta_{pcr}$==2.325−1.75$K_{cr}$ and this method has the advantages that burst risk characterization adopts a continuously quantified numerical value interval; and the other method is to determine $\eta_L$ according to a burst risk level obtained by the burst risk evaluation method based on the comprehensive index method commonly used at present, generally, $\eta_L$ is 0.75 in a strong burst risk zone, $\eta_L$ is 1.10 in a moderate burst risk zone, and is 1.45 in a weak burst risk zone.

In the calculation determination formula (20) of the drillhole spacing, $$\sqrt{\frac{\alpha}{\beta}}\sqrt{(1-\xi)\frac{1}{K}+1}$$

expresses a coal mass property factor, $\eta_{pcr}$ expresses a stress concentration degree factor, namely, the burst risk, and d expresses a geometric dimension factor of the drillhole diameter.

Figure 8:
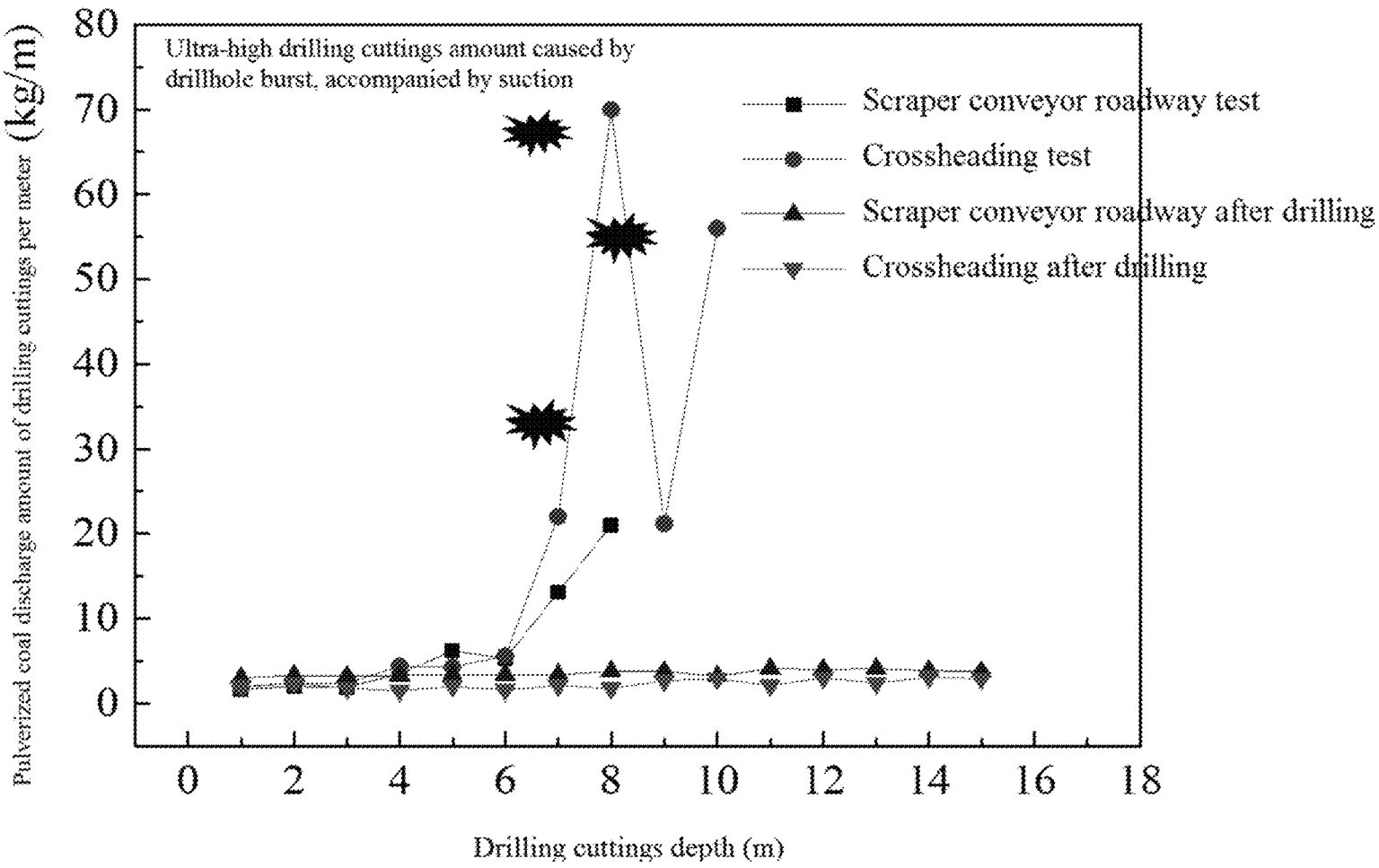
FIG. 8 is a comparison result diagram of the amount of drilling cuttings per meter of a typical drillhole before and after burst-preventing drilling construction in a roadway provided by an embodiment of the present invention.

In this embodiment, the burst-preventing drilling means is utilized to actively prevent and control the rock burst for stoping of 394 working face in the 5# district of the mine, and burst-preventing drilling is implemented 200 m ahead of the two stoping roadways in the working face. The drillhole diameter is 150 mm. Specially, for the zone with strong rock burst risk, the burst-preventing drillhole depth is 15 m, the hole spacing is 1.2 m, the drillholes are arranged perpendicular to the axial direction of the roadway, and the drillhole is 0.5-1.5 m away from the floor. When the working face is enabled to enter the strong burst risk zone of 340 m-487 m by pushing mining, and the burst risk of the surrounding rock is detected through a drilling cuttings method, dynamic phenomena of in-hole bursts, ultra-high drilling cuttings amount and suction and sticking occur in a drilling cuttings amount detection hole for many times. Such phenomena indicate that under the current construction parameters, burst-preventing drillholes fail to destroy the critical conditions for drillhole burst occurrence so as to achieve the purpose of preventing roadway rock burst initiation. As shown in FIG. 8, the maximum drilling cuttings amount of a single hole per meter is 70.0 kg/m, far exceeding a rock burst warning value of 4.3 kg/m.

In order to enhance the burst-preventing effect of the drillholes, in this embodiment, based on the burst-preventing drillhole parameter determination method for the rock burst roadways in the coal mines, the burst-preventing drillhole depth is obtained through optimization calculation, namely, 30.67 m for the strong burst risk zone, 28.31 m for the moderate burst risk zone, and 25.95 m for the weak burst risk zone; the burst-preventing drillhole spacing is obtained through optimization calculation, namely, 1.08 m for the strong burst risk zone, 1.58 m for the moderate burst risk zone and 2.08 m for the weak burst risk zone. See table 1 for details.

In this embodiment, according to the optimization design results of the burst-preventing drillhole parameters, when the drillhole spacing is adjusted to be 1.08 m and the drillhole depth is adjusted to be 30.67 m in the strong burst risk zone of 340 m-487 m of the working face, the pulverized coal amount of the drilling cuttings amount detection hole is reduced to 3.2 kg/m, the situations that the drilling cuttings amount is ultrahigh, suction power appears and the like do not occur, and the burst-preventing effect is improved to a large extent.

Table 1 Main parameters of roadway and burst-preventing drillhole, critical value of bursts and determination results of burst-preventing drillhole parameters

TABLE 1

Main parameters of roadway and burst-preventing drillhole, critical value of bursts and determination results of burst-preventing drillhole parameters

| Serial number | Parameter type | Name of main control parameters | Symbol | Unit | Value |
|---|---|---|---|---|---|
| 1 | main | burst modulus index | K | — | 1.30 |
| 2 | parameters of roadway | uniaxial compressive strength of coal rock | $\sigma_c$ | MPa | 11.12 |
| 3 | and | elastic modulus of coal rock | E | Gpa | 3.58 |
| 4 | drillhole | internal friction angle of coal rock | φ | degrees | 30 |
| 5 | | residual modulus reduction | $\lambda_2$ | MPa | 8.00 |
| 6 | | residual strength coefficient | ξ | — | 0.20 |
| 7 | | support stress | $p_s$ | MPa | 0.34 |
| 8 | | equivalent radius of roadway | $\rho_0$ | m | 2.37 |
| 9 | | drillhole diameter | d | m | 0.15 |
| 10 | critical conditions | critical mining peak stress for roadway rock burst initiation | $P_{mcr}$ | MPa | 50.98 |
| 11 | for roadway and drillhole | optimized critical mining peak stress for roadway rock burst initiation | $P^*_{mcr}$ | MPa | 45.37 |
| | bursts | critical stress for drillhole burst | $P_{hcr}$ | MPa | 28.75 |
| 12 | | surrounding rock critical softening depth for roadway rock burst initiation | $L_{pcr}$ | m | 23.59 |
| 13 | | critical plastic zone radius for drillhole burst occurrence | $r_{pcr}$ | m | 0.72 |
| 14 | optimization results of | coal seam thickness correction coefficient | $\eta_d$ | — | 1.0 |
| | burst-preventing | burst-preventing safety coefficient for drillhole depth | $\eta_L$ | — | 1.10, 1.20, 1.30 |

TABLE 1-continued

Main parameters of roadway and burst-preventing drillhole, critical value of bursts and determination results of burst-preventing drillhole parameters

| Serial number | Parameter type | Name of main control parameters | | Symbol | Unit | Value |
|---|---|---|---|---|---|---|
| | drillhole parameters | (classified as weak, moderate and strong burst risk levels according to the comprehensive index method) | | | | |
| 15 | | burst-preventing safety coefficient for drillhole spacing (classified as weak, moderate and strong burst risk levels according to the comprehensive index method) | | $\eta_{pcr}$ | — | 0.75, 1.10, 1.45 |
| 16 | | drillhole depth | strong | $L_{drill}$ | m | 30.67 |
| | | | moderate | | | 28.31 |
| | | | weak | | | 25.95 |
| 17 | | drillhole spacing | strong | $D_{drill}$ | m | 1.08 |
| | | | moderate | | | 1.58 |
| | | | weak | | | 2.08 |

Note:
"strong" represents that the roadway to be subjected to burst-preventing drilling construction has the strong rock burst risk,
"moderate" represents that the roadway to be subjected to burst-preventing drilling construction has the moderate rock burst risk, and
"weak" represents that the roadway to be subjected to burst-preventing drilling construction has the weak rock burst risk.

Note: "strong" represents that the roadway to be subjected to burst-preventing drilling construction has the strong rock burst risk, "moderate" represents that the roadway to be subjected to burst-preventing drilling construction has the moderate rock burst risk, and "weak" represents that the roadway to be subjected to burst-preventing drilling construction has the weak rock burst risk.

In addition, the present application further provides apparatus for controlling drilling for rock burst prevention in a coal mine roadway, the apparatus comprising a memory and a processor, the memory storing a program, and the program being executed by the processor to perform the method for controlling drilling for rock burst prevention in a coal mine roadway. The memory may comprise a volatile memory in a computer-readable medium, a random access memory (RAM) and/or a non-volatile memory, etc., such as a read-only memory (ROM) or a flash memory (flash RAM), and the memory comprises at least one memory chip. The memory is an example of a computer-readable medium.

Finally, it should be noted that the above embodiments are only utilized to illustrate the technical solutions of the present invention and not to limit the same. Although the present invention has been described in detail with reference to the foregoing embodiments, those of ordinary skill in the art should understand that the technical solutions described in the foregoing embodiments can be modified or some or all of the technical features thereof can be equivalently replaced. These modifications or replacements do not cause the essence of the corresponding technical solutions to deviate from the scope defined by the claims of the present invention.

The invention claimed is:

1. A method for controlling drilling for rock burst prevention in a coal mine roadway, comprising the following steps:

S1: acquiring rock mechanical parameters of coal mass in surrounding rock of a roadway to be subjected to burst-preventing drilling construction;

S2: calculating a surrounding rock critical softening depth $L_{pcr}$, a critical ground stress $P_{cr}$ and a critical mining peak stress $P_{mcr}$ of a surrounding rock stress concentration zone for rock burst initiation in the roadway to be subjected to burst-preventing drilling construction;

S3: acquiring a mining peak stress $P_m$ of the coal mass in the surrounding rock of the roadway to be subjected to burst-preventing drilling construction, optimizing the critical mining peak stress $P_{mcr}$ of the surrounding rock stress concentration zone for roadway rock burst initiation, and calculating a critical mining-induced stress index $K_{cr}$ of the roadway to be subjected to burst-preventing drilling construction;

$$K_{cr} = \frac{P_m}{P^*_{mcr}} \tag{1}$$

wherein $P_{mcr}$* is the optimized critical mining peak stress of the surrounding rock stress concentration zone for rock burst initiation in the roadway to be subjected to burst-preventing drilling construction;

S4: determining critical conditions for drillhole burst occurrence;

calculating a critical fracture zone radius $r_{dcr}$, a critical plastic softening zone radius $r_{pcr}$ and a critical stress $P_{hcr}$ for drillhole burst occurrence;

S5: determining a relationship between the critical conditions for drillhole burst occurrence and critical conditions for roadway rock burst initiation;

S6: quantitatively determining a drillhole diameter, a drillhole depth $L_{drill}$ and drillhole spacing $D_{drill}$ of burst-preventing drillholes according to the surrounding rock critical softening depth $L_{pcr}$ for roadway rock burst initiation, the critical plastic softening zone radius $r_{pcr}$ for drillhole burst occurrence and the critical mining-induced stress index $K_{cr}$; and

S7: controlling a drilling machine to operate according to the determined drillhole diameter, drillhole depth $L_{drill}$ and drillhole spacing $D_{drill}$ of the burst-preventing drillholes.

2. The method according to claim 1, wherein the rock mechanical parameters in S1 comprise uniaxial compressive strength $\sigma_c$, elastic modulus E, a burst modulus index $K=\lambda_1/E$, residual modulus reduction $\lambda_2$, and a residual strength coefficient $\xi$, wherein $\lambda_1$ is post-peak softening modulus.

3. The method according to claim 2, wherein the critical fracture zone radius $r_{dcr}$, the critical plastic softening zone radius $r_{pcr}$ and the critical stress $P_{hcr}$ for drillhole burst occurrence calculated in S4 are as shown in the following formula:

$$r_{dcr} = r_0\sqrt{\frac{\alpha}{\beta}} \tag{2}$$

$$r_{pcr} = r_0\sqrt{\frac{\alpha}{\beta}}\sqrt{(1-\xi)\frac{E}{\lambda_1}+1} \tag{3}$$

$$P_{hcr} = \frac{m+1}{2}\sigma_c\left(\frac{p_{dcr}}{\sigma_c}+\frac{1+\lambda_1/E}{m-1}\right)\left((1-\xi)\frac{1}{K}+1\right)^{\frac{m-1}{2}} - \frac{\sigma_c\lambda_1/E}{2}\left((1-\xi)\frac{1}{K}+1\right)^{\frac{m+1}{2}} - \frac{1+\lambda_1/E}{m-1}\sigma_c \tag{4}$$

wherein $$p_{dcr} = \left(\frac{\alpha}{1-q}\right)\left[1-\left(\frac{r_{dcr}}{r_0}\right)^{q-1}\right]+\left(\frac{\beta}{1+q}\right)\left[1-\left(\frac{r_{dcr}}{r_0}\right)^{q+1}\right]$$

is an acting stress of a surrounding rock fracture zone on a plastic softening zone when a drillhole burst occurs;

$$\alpha = \sigma_c\left[\frac{\lambda_2}{E}+\frac{\lambda_2}{\lambda_1}(1-\xi)+\xi\right],\ \beta = \sigma_c\left[\frac{\lambda_2}{E}+\frac{\lambda_2}{\lambda_1}(1-\xi)\right],\ m = \frac{1+\sin\varphi}{1-\sin\varphi},$$

$\varphi$ is an internal friction angle of a coal rock medium in the plastic softening zone of the roadway surrounding rock;

$$q = \frac{1+\sin\phi'}{1-\sin\phi'},$$

$\varphi'$ is an internal friction angle of the coal rock medium in the fracture zone of the roadway surrounding rock; and $r_0$ is a drillhole radius or a drill bit cutting radius.

4. The method according to claim 3, wherein the relationship between the critical conditions for drillhole burst occurrence and the critical conditions for roadway rock burst initiation determined in S5 meets the following relational expression:

$$P_{mcr}^{*}>P_{cr}>P_{hcr} \tag{5}$$

5. The method according to claim 4, wherein the drillhole diameter in S6 is determined according to the arrangement mode of the burst-preventing drillholes in the rock burst roadway and the self-conditions of the mine;

the drillhole depth $L_{drill}$ is determined based on the surrounding rock critical softening depth $L_{pcr}$ for roadway rock burst initiation, and is as shown in the following formula:

$$L_{drill}=\eta_d\eta_L L_{pcr} \tag{6}$$

wherein $\eta_d$ is a correction coefficient for coal seam thickness; when the coal seam thickness is greater than 0 m and less than 4 m, the value range of $\eta_d$ is $0.8\leq\eta_d\leq0.9$, when the coal seam thickness is 4-8 m, the value range of $\eta_d$ is $0.9<\eta_d\leq10$; when the coal seam thickness is greater than 8 m, the value range of $\eta_d$ is $1.0<\eta_d\leq1.2$; $\eta_L$; is a burst-preventing safety coefficient for the drillhole depth; two determination methods are provided for $\eta_L$: one is to determine $\eta_L$ according to the critical mining-induced stress index $K_{cr}$ of burst risk evaluation, namely $\eta_L=0.85+0.5K_{cr}$; and the other method is to determine $\eta_L$ according to a burst risk level obtained by burst risk evaluation based on a comprehensive index method;

the drillhole spacing $D_{drill}$ is determined based on the critical plastic softening zone radius $r_{pcr}$ for drillhole burst occurrence, and is as shown in the following equation:

$$D_{drill}=2\eta_{pcr}r_{pcr} \tag{7}$$

formula (3) is combined with formula (7) to further obtain $$D_{drill} = \eta_{pcr}d\sqrt{\frac{\alpha}{\beta}}\sqrt{(1-\xi)\frac{1}{K}+1} \tag{8}$$

wherein $\eta_{pcr}$ is a burst-preventing safety coefficient for the burst-preventing drillhole spacing, d is the diameter of a drill bit in burst-preventing drilling construction, $d=2r_0$; two determination methods are provided for $\eta_{pcr}$: one is to determine $\eta_{pcr}$ according to a critical stress index method of burst risk evaluation, namely $\eta_{pcr}=2.325-1.75K_{cr}$; and the other method is to determine $\eta_{pcr}$ according to the burst risk level obtained by the burst risk evaluation method based on the comprehensive index method.

6. An apparatus for controlling drilling for rock burst prevention in a coal mine roadway, the apparatus comprising a memory and a processor that is configured to perform the method according to claim 1.

* * * * *